United States Patent [19]

Galia

[11] Patent Number: 4,477,001

[45] Date of Patent: Oct. 16, 1984

[54] VALVE FOR PRESSURIZED CONTAINER

[75] Inventor: Karl Galia, Öhningen, Fed. Rep. of Germany

[73] Assignee: Wella Aktiengesellschaft, Darmstadt, Fed. Rep. of Germany

[21] Appl. No.: 293,207

[22] PCT Filed: Dec. 5, 1980

[86] PCT No.: PCT/DE80/00181

§ 371 Date: Aug. 11, 1981

§ 102(e) Date: Aug. 11, 1981

[87] PCT Pub. No.: WO81/01696

PCT Pub. Date: Jun. 25, 1981

[30] Foreign Application Priority Data

Dec. 11, 1979 [DE] Fed. Rep. of Germany ..... 2949666

[51] Int. Cl.[3] ..... B65D 83/14

[52] U.S. Cl. ..... 222/402.1; 222/507; 222/509; 222/514; 222/518

[58] Field of Search ..... 222/507, 509, 514, 518, 222/402.1; 251/353

[56] References Cited

U.S. PATENT DOCUMENTS

| | | | |
|---|---|---|---|
| 234,035 | 11/1880 | Houts | 222/518 |
| 2,437,589 | 3/1948 | Bink | 222/514 X |
| 3,052,382 | 9/1962 | Gawthrop | 222/514 X |
| 3,372,844 | 3/1968 | Kitabayashi | 222/402.1 |
| 4,120,431 | 10/1978 | Schultz | 222/518 |

FOREIGN PATENT DOCUMENTS

| | | | |
|---|---|---|---|
| 200992 | 12/1958 | Australia | 222/518 |
| 489184 | 9/1977 | Australia | 222/402.1 |

*Primary Examiner*—Joseph J. Rolla
*Assistant Examiner*—Frederick R. Handren
*Attorney, Agent, or Firm*—Michael J. Striker

[57] ABSTRACT

A valve for pressurized containers with a closing member which is movable toward a valve seat and engages thereon in a rest position or closing position is proposed. The valve includes a bushing which is fixedly inserted into the container and partly surrounds a sliding sleeve which at its upper end is provided with the valve seat and includes at its lower inner end a plurality of recesses. Connected to the bushing are a plurality of arms wherein each of the arms is guided through a respective one of the recesses. A rod which is disposed centrically and slidable within the bushing and the sliding sleeve and which on its upper end is provided with the closure member is in connection at its lower end with each of the arms so that upon downward movement of the sliding sleeve the arms are moved radially outwardly and the valve is opened. Since the bushing has a certain elasticity and an elastic return force, the valve is closed when no pressure is exerted on the sliding sleeve so that the bushing is moving the arms in its original position and closes the valve again.

16 Claims, 7 Drawing Figures

FIG.1
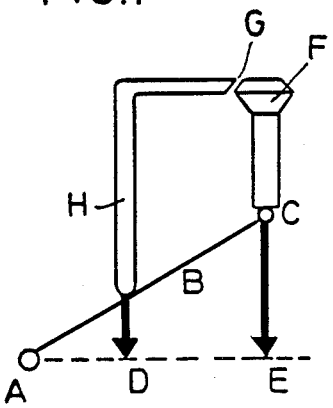
FIG.3
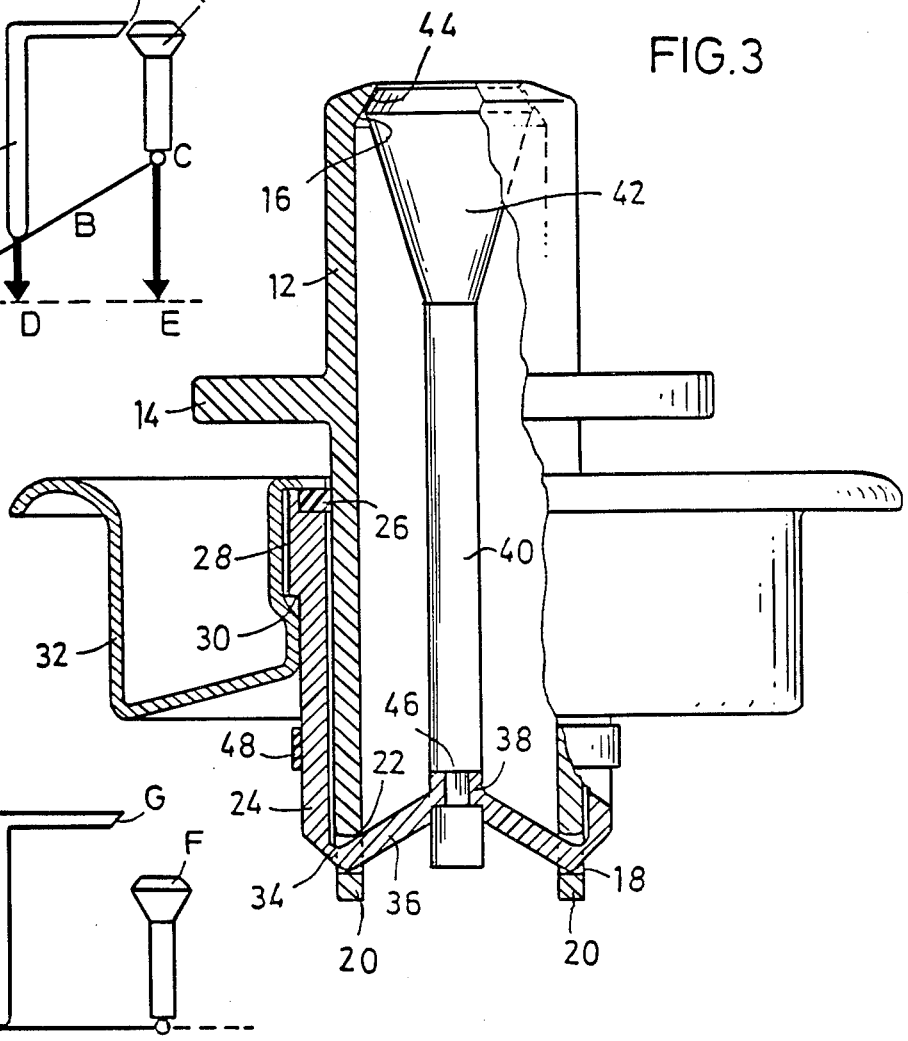
FIG.2

VALVE FOR PRESSURIZED CONTAINER

BACKGROUND OF THE INVENTION

The invention relates to a valve for pressurized containers, like aerosol containers with a closing member which is movable towards a valve seat and engages thereon in its rest position or locking position.

It is known to fill paste and liquids together with a gas like propelling means into containers. Thereby, containers are known wherein the product together with the propelling means are charged into one chamber. When opening the valve, the product is discharged under the influence of the propellant and is propelled therewith as a spray, or the like. Furthermore, containers are known, wherein the product and the propellant are separated from each other. Such containers have an elastic inner bag for receiving the product. In such a container, the gas like propellant is disposed in the annular like space between the inner bag and the container. In these containers, the elastic inner bag is closed to the outside by a valve. When opening the valve, the propellant can expand and press the inner bag together, thus driving the product therefrom. The same valves are used for both container types. They will be opened either by pressure or the sliding displacement movement of a part. Furthermore, they have a special spring or a spring element made of metal, rubber or an elastic plastic material which presses the closing member on the valve seat in the closing position. The push for opening the valve is carried out by pushing against this spring element.

SUMMARY OF THE INVENTION

It is an object of the subject invention to provide a valve of this type which is opened by pushing, but which does not require a special spring element. In this context it should be mentioned that the individual parts of a valve of the type in question are usually made with the extrusion molding method from plastic material with different elasticity. By omitting a spring element, not only a structural element is eliminated but also its manufacturing and assembly, but there is also the possibility to operate without any metal or a special selected plastic material which has the required yielding characteristics. The elimination of such plastic material and, in particular metal is advantageous in products which should not come into contact with metal, because it would change their characteristics.

The physical principle on which the inventive solution to the object of the invention is based, will now be explained with respect to FIGS. 1 and 2. During a pivoting from the position A-C shown in full lines into the position A-E shown in dash-dot lines, the points B and C have travelled different paths. The path B-D is shorter than the path C-E. These differently long paths are illustrated by the arrows. It has to be assumed that the part F is a valve closing member which engages on its valve seat G. The valve seat G would be connected with the part H. Within this meaning it is further assumed that the valve closing member F is connected with the point C and the valve seat G with the point B of the assumed lever A-C. When pivoting this lever into the position A-E the member F has moved downwardly by the larger path C-E and valve seat G by the shorter path B-D. This results in the picture shown in FIG. 2. The valve seat locking member F is no longer in engagement with valve seat G. The valve is open. In a constructive realization of these theoretical considerations the valve would open or close due to the different speeds of its locking member and its valve seat. Thereby, for the moment it is to be assumed that B and C do not move in a circular path around A, but that they can perform the linear movements B-D and C-E.

The constructive realization in a valve of the aforementioned type, in view of the just mentioned idea, is realized by using the following features:

(a) a bushing fixedly insertable into the container, (b) a sliding sleeve is slideably guided therein which at its upper end is provided with the valve seat and at its lower inner end with recesses, (c) arms which are connected with a bushing through joints and which extend radially therefrom and are guided to the inside through recesses, (d) a rod is disposed centrically and slidably within the bushing and the sliding sleeve which on its upper end is provided with the closing member and is connected with its lower end with the inner radial ends of the arms, whereby the joints and the adjacent areas of the bushing are elastic in such a manner that the displacement of the arms in a radially outward direction which displacement is produced by a downward movement of the the sliding sleeve in a direction radially outwardly is reversible.

The inventive sliding sleeve valve represents the part H with seat G. The arms form the lever A-C. The rod corresponds to the part which supports the closing member F. The bushing which is fixedly insertable into the container forms the rotating point A or a plurality of rotating points A, if a plurality of arms are used.

The arms which are disposed in their recesses are moved during the downward movement of the sliding sleeve or when pushing the sliding sleeve into the valve. They perform a pivot movement around their joint at the bushing. Thereby, they are moving the rod with the closing member. In accordance with the aforementioned explanations with respect to FIG. 1, the rod now travels a longer path than the sliding sleeve and the valve opens. Since the rod and the sliding sleeve perform linear movements are not a circular movement around A or the joint of the arms on the bushing, the joint must deflect radially. Such a movement is present. It is the result of the elasticity of the plastic material which forms the bushing. Therefore, the elasticity of the bushing replaces the spring or the spring element of the known valves. Due to its elasticity, the bushing assumes its original position again, after releasing the sliding sleeve. Its radially deflected area retracts again and thereby pushes the sliding sleeve and the rod back into their original position. Thereby, the closing member again engages the valve seat and the valve is closed.

Therefore, the inventive valve operates without a special spring element. The plastic material which forms the bushing must be merely so adjusted that it contains the desired elasticity and spring force.

It is recommended that the arms encompass an acute angle with the bushing in their rest position, and that the elastic return force of the bushing material is so large that it returns to its rest position, after a radially outward movement. The so-called acute angle between the arms and the bushing provides that the bushing moves the arms during its radial inward movement, in the plan view of FIGS. 1 and 2, upwardly or in closing position of the closing member. Thereby, the valve returns by itself to its closing position after an opening, as required.

In an advantageous embodiment it is provided that the bushing together with the joints and the arms are designed as a unitary part (molded), whereby the joints with the arms are tip stretched on the lower end of the bushing. Generally, one would use four arms. However, it is also feasable to use three, five or any number of arms.

For connecting the rod with the arms, a particular advantageous embodiment provides that the rod is provided with an annular recess at its lower end, that the arms are provided with shoulders at their inner ends or annular rings which are pressed into the recess.

In a further embodiment it is provided that the recesses in the sliding sleeve are provided in the lower open end thereof, that ribs extend from this end from a side to about half into the recesses, and that they are provided at their free ends with arresting protrusions in such a manner that the arms which are guided through the recesses, are supported on ribs and are clamped therebetween and a lateral upper limit of the recesses and an arresting protrusion. In the practice, this means that one mounts the sliding sleeve with its recesses onto the arms which extend from the bushing, pushes it down to a certain extent and then turns it.

It had been stated that the sliding sleeve is pushed for opening the valve. An advantageous embodiment provides for this purpose that the sliding sleeve protrudes from the bushing and that at the protruding portion a gripping edge is provided at a distance above the upper edge of the bushing, that this gripping edge overlies the container lid, whereby this gripping edge limits to the maximum stroke of the rod. Thereby, the gripping edge is a handle for pushing down the sliding sleeve and also an abutment for limiting the stroke.

In a further embodiment extensions are provided on the arms and the upper faces of the recesses are so shaped that they form pivot supports together with the engaging extensions. This reduces the opening force and prevents a possible jamming.

In a further embodiment it is provided that the bushing encompasses the slide sleeve at such a tight distance that it constitutes a guide therefor, that a groove is provided on the inner wall of the bushing, and a sealing ring is retained therein engaging a sliding sleeve. In an alternative embodiment a sealing lip is tip stretched on the outer wall of the sliding sleeve at the area encompassed by the bushing which engages therewith.

Instead of a connection between arms and rods, wherein the arms engage on the rod, an alternative embodiment provides that the rod is integrally connected with arms by means of material reduced joints. In this embodiment, the valve closing member is a separate structural element which is pushed onto the rod and is connected therewith by a groove and bead joint.

The invention further provides that the faces of the valve seat and the valve closing member which are in engagement with each other in the closing or resting position are conically shaped, whereby the taper is selectively differently chosen, so that a linear outer axial engagement is provided.

For supporting the radially inwardly active return force of the bushing it is provided that an elastic set ring engages on the bushing in the area of the elastic radial expansion.

The invention also provides the possibility to mount the unitary valve unit simply onto a container, an aerosol container, a bottle, or the like and to connect it with such a container, or the like. In detail, it is provided that the bushing is disposed concentrically and with a radial distance within a sleeve unitarily connected therewith, and that it is mountable in a pressure tight manner onto a container, or the like. Thereby, the bushing may be provided with a thread for screw capping, a snap lock for mounting or any other closing or arresting means for connection with the container, the can, the bottle, or the like.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is the already explained plan view of the physical principle which is the basis of the invention, FIG. 2 is also an already explained view similar to FIG. 1, FIG. 3 is a side view, partially in a section, of one embodiment of the inventive valve.

DESCRIPTION OF THE PREFERRED EMBODIMENTS

Figure 4:
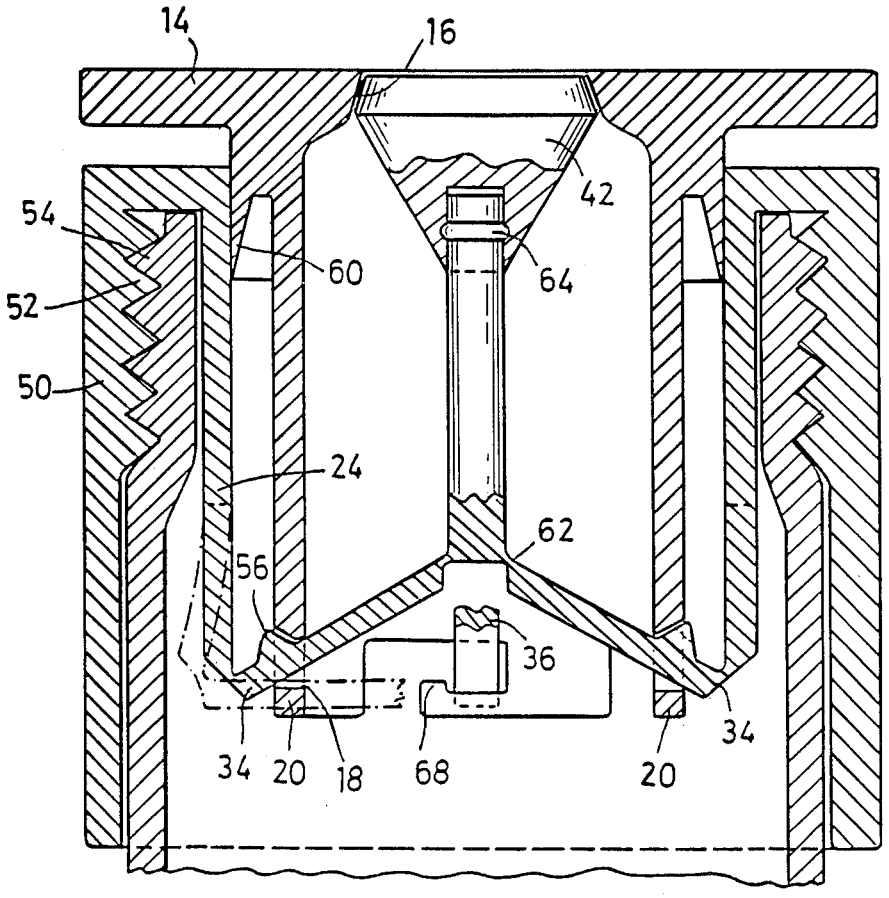
FIG. 4 is a side view, partially in a section, of a second embodiment of the inventive valve.
Figure 7:
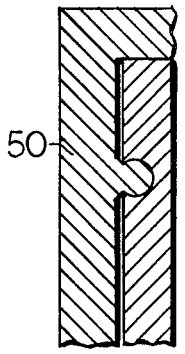
FIG. 6 is the plan view of the bushing of the second embodiment and FIG. 7 is a side view in section of a snap lock for mounting the present invention on a container.

FIG. 3 shows the sliding sleeve 12 with the gripping edge 14 and the seat 16. Four recesses 18 are provided in the lower end of the sliding sleeve 12. Although, FIG. 5 shows the sliding sleeve 12 of the alternative embodiment in accordance with FIG. 4, the recesses 18 are identical in both embodiments. Therefore, with respect to the recesses 18, it can be referred back to FIG. 5. In the downward extension the recesses 18 are partially limited by the ribs 20. The upper faces of the recesses 18 form the pressure edges 22. The bushing 24 encompasses the sliding sleeve 12. In a manner, which is of no interest here, it is fixedly mounted with the container, the aerosol container, a bottle or the like, and is connected therewith. A sealing ring 26 is disposed in a groove or recess of the bushing 24. It engages the sliding sleeve bushing 12. It seals the inner chamber of the container, or the like, to the outside. In addition, it guides the sliding sleeve 12 into the bushing 24, during its inward movement. The bushing 24 is also provided with a radially extending shoulder 28. This shoulder forms an edge 30. This shoulder engages on a radial indentation of the lid of the container, the can, or the like. The joints 34 and the arms 36 extending therefrom are tip stretched onto the bushing 24 or are molded thereon. The joints 34 are formed by material reductions. The arms 36 are provided with shoulders 38 on their inner radial ends, or they are connected into a ring 38. The rod 40 together with the valve sealing member 42 and the sealing face 44 are centrically disposed within sliding sleeve 12. At its lower end it is provided with an indentation 46. The shoulders 38 or the ring 38 are pushed into this indentation. FIG. 3 also shows the set ring 48 which can be selectively used.

Figure 5:
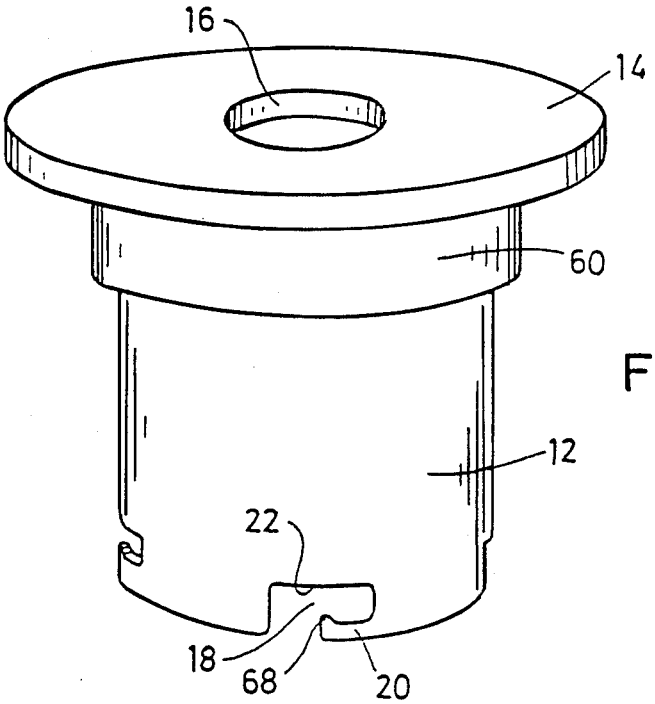
FIG. 5 is the plan view of the sliding sleeve valve of the second embodiment.
Figure 6:
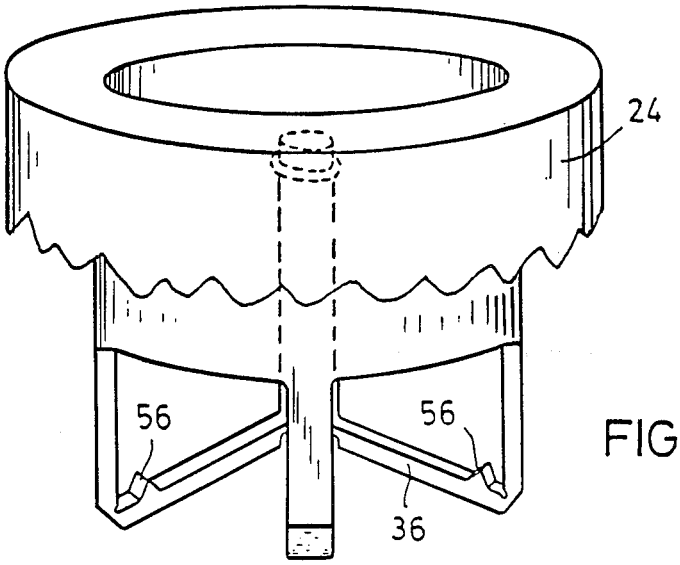

The embodiment shown in FIG. 4 differs from the embodiment of FIG. 3 only in the structural details. The bushing 24 is combined into one unitary structural element with a sleeve 50 which encompasses the bushing. The sleeve 50 has an inner thread 52. With this thread it is screwed onto the neck 54 of a bottle, or the like, which is also provided with a thread. In contrast to the embodiment of FIG. 3 the arms 36 are provided with extensions 56. These are engaging the complimentary shaped upper surfaces of recesses 18. Thereby, pivot supports are generated for the pivot movement of arms 36. A sealing lip 60 is tip stretched on the outer side of the sliding sleeve 12. It serves to guide the sliding sleeve 12 in bushing 24 in the same manner as sealing ring 26. The rod 40 is connected in one unit with arms 36 and thereby with bushing 24, which is different from the embodiment of FIG. 3. Material reductions are disposed between the rod 40 and the arms 36 forming joints 62. However, in this case the valve closing member 42 is a separate structural element. It is pushed onto the rod 40 and is connected therewith by means of a groove and bead joint 64. FIGS. 4 and 5 show the arresting extensions 68 on the ends of ribs 20.

After this detailed description of the two embodiments, the mode of operation will now be described:

The valve, be it in the embodiment of FIG. 3 or FIG. 4, is mounted on a container, an aerosol can, or the like. The space within the sliding sleeve 12 is under the pressure of the propellant through the intermediary space between the four arms 36. The gripper edge 14 is pushed for opening the valve. This downward movement is stopped at least when the lower side engages the upper side of the can lid 32 or the sleeve 50. During the downward movement of the sliding sleeve 12 the pressure edges 22 at the upper sides of the recesses 18 push against the arms 36 or the extensions 56, respectively. Thereby, the lower area of the bushing 24 is moved radially to the outside. In FIG. 4, this is shown on the left side in dash-dot lines. Thereby, the arms also perform a movement. This movement is composed of two components. The one component is a linear downward movement. The second movement is a pivot movement. In accordance with the embodiment of FIG. 3, the center of this pivot movement is in the joints 34 and in the embodiment in accordance with FIG. 4 in the pivot supports between the pressure edges 22 and the extensions 56. The rod 40 follows the first movement component and moves downwardly. Thereby, the valve closing member 42 moves away from the valve seat 16. The valve opens. The theoretic end position of this movement is shown in the left lower portion of FIG. 4. In dash dot lines an arm 36 is shown in a horizontal position. This is the position of an arm 36 at a full opening of the valve. A comparing view to FIGS. 1 and 2 shows that the valve closing member 42 has been moved further downwardly than the valve seat 16 during this movement process, so that the valve opens.

After the valve remained open for the desired time period, the gripping edge 14 is released. The elasticity and the return force of the bushing 24 becomes active. In its lower area it retracts radially and assumes its position shown in FIGS. 3 and 4. Since the arm 36 encompass an acute angle therewith in the maximum open position, the arms pivot during this movement in such a manner that the rod 40 is moved upwardly and the valve closing member 42 is moved into the closing position. This radial inward movement of the lower area of the bushing 24 is aided by the set ring 48, if the same is present.

I claim:

1. A valve for pressurized dispensing containers, with a closing member which is movable towards a valve seat and engages thereon in its rest position or closing position, characterized by (a) a bushing (24) fixedly insertable into the container, (b) a sliding sleeve (12) slidably guided in the bushing which at its upper end is provided with the valve seat (16) and at its lower inner end with recesses (18), (c) a plurality of arms (36) each being connected with the bushing (24) through respective joints (34) and extending radially therefrom and being guided to the inside through one of the recesses (18), and (d) a rod (40) disposed centrically and slidable within the bushing (24) and the sliding sleeve (12) and which on its upper end is provided with the closing member (42) and is connected at its lower end with the inner radial end of the arms (36), wherein the joints (34) and the adjacent areas of the bushing (24) are elastic in such a manner that the displacement of the outer ends of the arms (36) in a radially outwardly direction, which displacement is produced by a downward movement of the sliding sleeve sleeve (12), is reversible.

2. A valve in accordance with claim 1, characterized in that the arms (36) encompass an acute angle in their rest position with the bushing (24), and that the elastic return force of the material of the bushing (24) is so large that it returns the bushing into its rest position, after a radially outward movement.

3. A valve in accordance with claim 1 characterized in that the bushing (24) together with the joints (34) and the arms (36) is a unitary part, wherein the joints (34) together with the arms (36) are formed on the lower end of the bushing (24).

4. A valve in accordance with claim 1 characterized in that the rod (40) is provided with an annular indentation (46) at its lower end, that the arms (36) are provided with shoulders (38) at their inner ends, and that the shoulders are pushed into the indentation (46).

5. A valve in accordance with claim 1 characterized in that the recesses (8) in the sliding sleeve (12) are provided in the lower open end thereof, that ribs (20) extend from this end from one side to about half into the recesses (18), and that the ribs are provided at their free ends with arresting protrusions (68) in such a manner that the arms (36) which are guided through the recesses (18) are supported on the ribs (20) and are clamped therebetween and a lateral end and an upper limit of the respective recess (18) and an arresting protrusion (68).

6. A valve in accordance with claim 1, characterized in that the sliding sleeve (12) protrudes from the bushing (24) to define a protruding portion and that at the protruding portion a gripping edge (14) is provided at a distance above the upper edge of the bushing (24) or the container lid (32) retaining the bushing, wherein this distance corresponds to the maximum stroke of the rod (40).

7. A valve in accordance with claim 1, characterized in that each rm (36) has an upper face provided with at least one extension (56) and that the recesses (18) are associated to form pivot supports together with the engaging extensions (56).

8. A valve in accordance with claim 1, characterized in that the bushing (24) encompasses the slide sleeve (12) at such a tight distance that it constitutes a guide therefor, that the inner wall of the bushing (24) is provided with a groove in which a sealing ring (26) is retained bearing on the sliding sleeve (12).

9. A valve in accordance with claim 1, characterized in that on the outer wall of the sliding sleeve (12) a sealing lip (60) is formed in the area encompassed by bushing (24) which sealingly abuts the inner surface of the bushing.

10. A valve in accordance with claim 1, characterized in that the rod (40) is integrally connected to the arms (36) by means of joints (62) formed by reduction in material.

11. A valve in accordance with claim 1, characterized in that the valve closing member (42) is pushed onto the rod (40) and is connected therewith by a groove and bead joint.

12. A valve in accordance with claim 1, characterized in that the faces of the valve seat (16) and the valve closing member (42) which are in engagement with each other in the closing or resting position are conically shaped, wherein the taper is selectively differentially chosen, so that a linear engagement is provided axially on the outside.

13. A valve in accordance with claim 1, characterized in that the bushing is circumscribed by an elastic set ring (48) in the area of the elastic radial expansion.

14. A valve in accordance with claim 1, characterized in that the bushing (24) is disposed concentrically and radially spaced within a sleeve (50) integrally connected therewith, and that it is mounted in a pressure tight manner onto a container, or the like.

15. A valve in accordance with claim 14, characterized in that the sleeve (50) is provided with a thread (52) for a container to be screwed thereon.

16. A valve in accordance with claim 14, characterized in that the sleeve (50) has a snap lock for mounting on said container.

* * * * *